US008042344B2

(12) United States Patent
Morimoto et al.

(10) Patent No.: US 8,042,344 B2
(45) Date of Patent: Oct. 25, 2011

(54) AUTOMATIC ICE MAKING MACHINE AND OPERATION METHOD THEREFOR

(75) Inventors: Ryoji Morimoto, Toyoake (JP); Tomohiro Takagi, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 481 days.

(21) Appl. No.: 12/308,965

(22) PCT Filed: Nov. 1, 2007

(86) PCT No.: PCT/JP2007/071347

§ 371 (c)(1),
(2), (4) Date: Dec. 30, 2008

(87) PCT Pub. No.: WO2008/053975

PCT Pub. Date: May 8, 2008

(65) Prior Publication Data

US 2009/0320501 A1 Dec. 31, 2009

(30) Foreign Application Priority Data

Nov. 2, 2006 (JP) ..... 2006-299359

(51) Int. Cl.
*F25C 1/00* (2006.01)

(52) U.S. Cl. ..... 62/74; 62/340

(58) Field of Classification Search ..... 62/66, 71, 62/74, 340, 347, 349
See application file for complete search history.

(56) References Cited

U.S. PATENT DOCUMENTS

| | | | | |
|---|---|---|---|---|
| 4,901,539 | A * | 2/1990 | Garber et al. | 62/306 |
| 4,959,971 | A * | 10/1990 | Minari | 62/197 |
| 5,493,872 | A * | 2/1996 | Hibino et al. | 62/347 |
| 6,076,749 | A * | 6/2000 | Moore et al. | 239/556 |
| 6,349,557 | B1 * | 2/2002 | Gresham | 62/347 |
| 7,010,933 | B2 * | 3/2006 | Ishitomi et al. | 62/347 |
| 2004/0226311 | A1 * | 11/2004 | Ishitomi et al. | 62/348 |
| 2005/0016190 | A1 * | 1/2005 | Wakatsuki | 62/135 |
| 2005/0252233 | A1 * | 11/2005 | Sanuki et al. | 62/347 |
| 2006/0272339 | A1 * | 12/2006 | Wakatsuki | 62/66 |

FOREIGN PATENT DOCUMENTS

| | | |
|---|---|---|
| JP | S63-233276 | 9/1988 |
| JP | H4-268181 | 9/1992 |
| JP | 2005-156002 | 6/2005 |
| JP | 2006-064290 | 3/2006 |

* cited by examiner

*Primary Examiner* — Mohammad Ali
(74) *Attorney, Agent, or Firm* — DLA Piper LLP (US)

(57) ABSTRACT

To restrict the deposition of stain on an ice making unit, and prevent damage to resin components or the like. The above problems are solved by the followings. Ice making water is supplied to the front surface of an ice making plate cooled by refrigerant supplied to an evaporation tube during an ice making cycle to produce ice blocks. During a deicing cycle, deicing water is supplied by opening a water feed valve WV to the rear surface of the ice making plate to be heated by hot gas supplied to the evaporation tube. When a water feed time has elapsed, the water feed valve WV is closed to temporarily stop deicing water supply. After the water feed time elapsed, a cycle, in which the water feed valve WV is opened as much as an intermittent water supply time every time an intermittent stopping time has elapsed to intermittently supply deicing water, is repeated until a deicing cycle completes.

6 Claims, 5 Drawing Sheets

(a)

(b)

(c)

AUTOMATIC ICE MAKING MACHINE AND OPERATION METHOD THEREFOR

TECHNICAL FIELD

The present invention relates to an automatic ice making machine which supplies deicing water to an ice making unit heated by heating means to separate ice blocks produced by the ice making unit at the time of a deicing cycle, and an operation method for the automatic ice making machine.

BACKGROUND ART

As an ice making machine that automatically makes ice blocks, there is known a down flow type ice making machine in which an evaporation tube constituting a freezing system is arranged in a meandering manner at the rear surface of an ice making plate disposed approximately vertically, and ice making water is let to flow down the top surface of the ice making plate at the time a refrigerant is circulatively supplied to the evaporation tube to cool the ice making plate at the time of an ice making cycle, after which the cycle goes to a deicing cycle to separate and drop the ice blocks from the ice making plate.

At the time of the deicing cycle of the down flow type ice making machine, hot gas is circulatively supplied to the evaporation tube and deicing water of normal temperature is let to flow down to the rear surface of the ice making plate to heat the ice making plate, thereby melting ice forming surfaces between the ice blocks and the ice making plate, so that the ice blocks drop by the dead weight. The deicing water supplied to the ice making plate is collected in an ice-making water tank located under the ice making plate to be used as ice making water next time. An overflow tube is disposed in the ice-making water tank, that amount of deicing water collected in the ice-making water tank which is more than a prescribed water level prescribed by the overflow tube is discharged outside through the overflow tube.

In the down flow type ice making machine, when a temperature sensor detects that the temperature of a hot gas whose temperature rapidly rises as a result of separation of all of ice blocks in the deicing cycle has reached a preset deicing completion temperature, it is considered that deicing has been completed and control is performed to stop the deicing cycle and switch the cycle to the ice making cycle. In this case, the deicing water supplied to the ice making plate which is to be collected in the ice-making water tank at the time of the deicing cycle is set to become the prescribed water level before the time to the deicing completion temperature from the beginning of the deicing cycle, which is obtained in experiments or the like, i.e., before completion of the deicing cycle, in consideration of a variation or the like in the flow rate of the deicing water from the deicing water supply source. If the deicing water is kept supplied until the deicing cycle is completed, therefore, a large amount of deicing water is discharged wastefully, increasing the amount of water consumed. In this respect, there is a proposal to suppress the amount of wasted deicing water by stopping supplying deicing water to the ice making plate upon elapse of a supply time to collect deicing water whose amount does not make next ice making water insufficient in the ice-making water tank (see Patent Document 1, for example).

Patent Document 1: Japanese Patent Application Laid-Open No. 2006-64290

DISCLOSURE OF THE INVENTION

Problems to be Solved by the Invention

As ice-block separated portions of the ice making plate are in a load free state where there are no ice blocks, the temperature of the ice-block separated portions of the ice making plate rises to dry the top surface thereof at the time of deicing with a hot gas after supply of deicing water is stopped, so that stains on the top surface are crystallized to accelerate adhesion. When stains are adhered to the ice making plate to make the top surface irregular, separation of ice blocks is inhibited, making the time needed for deicing longer, which brings about the problem of reducing the ice making performance.

When the adhesion of stains progresses to make deicing longer, the time to heat the ice making plate with the hot gas after the supply of the deicing water is stopped becomes longer, overheating the ice making plate, which may cause damages, such as cracking and thermal deformation of resin components disposed around the ice making plate.

Accordingly, the present invention has been proposed to suitably solve the inherent problems of the conventional technique, and it is an object of the invention to provide an automatic ice making machine capable of suppressing adhesion of stains to the ice making unit and preventing resin components or the like from being damaged, and an operation method for the automatic ice making machine.

Means for Solving the Problems

To overcome the problems and suitably achieve the expected object, an operation method for an automatic ice making machine according to the subject matter in claim 1 is an operation method for an automatic ice making machine which supplies ice making water to an ice making unit cooled by a refrigerant supplied to an evaporation tube to produce ice blocks at a time of an ice making cycle, and heats the ice making unit with heating means to separate the ice blocks from the ice making unit at a time of a deicing cycle, and is characterized in that at the time of the deicing cycle, a predetermined amount of deicing water is continuously supplied to the ice making unit from deicing water supplying means after which the deicing water is intermittently supplied to the ice making unit from the deicing water supplying means.

According to the invention of claim 1, with the amount of consumed water being suppressed by intermittent supply of deicing water, drying of the ice making unit can be prevented and adhesion of stains to the ice making unit can be suppressed. It is therefore possible to prevent the time for deicing from becoming longer due to stains adhered to the ice making unit, preventing the ice making performance from being reduced. In addition, overheating of the ice making unit can be suppressed by intermittent supply of deicing water, so that resin components or the like which are susceptible to heat can be prevented from being damaged. Further, intermittently supplied deicing water can accelerate separation of ice blocks, which brings about an effect of shortening the deicing time.

The outline of the subject matter of claim 2 is that a time needed from stopping of continuous supply of the deicing water to the ice making unit to completion of the deicing cycle is estimated, and when the estimated time is shorter than a preset cancel time, intermittent supply of the deicing water to the ice making unit is not performed.

According to the subject matter of claim 2, when the estimated time needed from stopping of continuous supply of the deicing water to completion of the deicing cycle is shorter than the cancel time, intermittent supply of the deicing water to the ice making unit is not performed, making it possible to further reduce the amount of consumed deicing water when there is a small influence of adhesion of stains to the ice making plate.

To overcome the problems and suitably achieve the expected object, an automatic ice making machine according to the invention of claim 3 is configured to supply ice making water to an ice making unit cooled by a refrigerant supplied to an evaporator to produce ice blocks at a time of an ice making cycle, and heat the ice making unit with heating means to separate the ice blocks from the ice making unit at a time of a deicing cycle, characterized by comprising:

detection means for detecting that a predetermined amount of deicing water is continuously supplied to the ice making unit from deicing water supplying means at the time of the deicing cycle; and control means for controlling an operation of the ice-making water supplying means in such a way as to intermittently supply the deicing water to the ice making unit from deicing water supplying means until the deicing cycle is completed after detection of the supply of the predetermined amount of deicing water by the detection means.

According to the invention of claim 3, with the amount of consumed water being suppressed by intermittent supply of deicing water, drying of the ice making unit can be prevented and adhesion of stains to the ice making unit can be suppressed. It is therefore possible to prevent the time for deicing from becoming longer due to stains adhered to the ice making unit, preventing the ice making performance from being reduced. In addition, overheating of the ice making unit can be suppressed by intermittent supply of deicing water, so that resin components or the like which are susceptible to heat can be prevented from being damaged. Further, it is possible to accelerate separation of ice blocks, which brings about an effect of shortening the deicing time.

The outline of the subject matter of claim 4 is that the control means estimates a time needed from stopping of continuous supply of the deicing water to the ice making unit to completion of the deicing cycle, and controls the operation of the deicing water supplying means in such a way as not to intermittently supply the deicing water to the ice making unit when the estimated time is shorter than a preset cancel time.

According to the subject matter of claim 4, when the estimated time needed from stopping of continuous supply of the deicing water to completion of the deicing cycle is shorter than the cancel time, the operation of the deicing water supplying means is controlled in such a way as not to intermittent supply deicing water to the ice making unit, making it possible to further reduce the amount of consumed deicing water when there is a small influence of adhesion of stains to the ice making plate.

The outline of the subject matter of claim 5 is that the automatic ice making machine is configured to collect the deicing water supplied to the ice making unit in an ice-making water tank at the time of the deicing cycle, discharge that amount of deicing water collected in the ice-making water tank which is more than a prescribed amount of deicing water outside, and use the prescribed amount of deicing water as ice making water in a next ice making cycle.

According to the subject matter in claim 5, the intermittent supply of deicing water can suppress the amount of deicing water supplied to the ice-making water tank which is greater than the prescribed amount, so that the amount of deicing water to be wastefully discharged from the ice-making water tank can be reduced while securing the prescribed amount of ice making water.

ADVANTAGE OF THE INVENTION

According to the automatic ice making machine according to the present invention and the operation method therefor, after a predetermined amount of deicing water is supplied, drying of the ice making unit can be prevented and adhesion of stains to the ice making unit can be suppressed with the amount of consumed water being suppressed by intermittent supply of deicing water. Then, the suppression of stains to the ice making unit can prevent the deicing cycle from becoming longer, preventing the ice making performance from being reduced and preventing resin components or the like from being damaged by overheating of the ice making unit.

BEST MODE FOR CARRYING OUT THE INVENTION

Next, an automatic ice making machine according to the present invention and an operation method therefor will be described below by way of preferred embodiments referring to the accompanying drawings. In the embodiments, a down flow type automatic ice making machine is described as an automatic ice making machine.

First Embodiment

Figure 1:
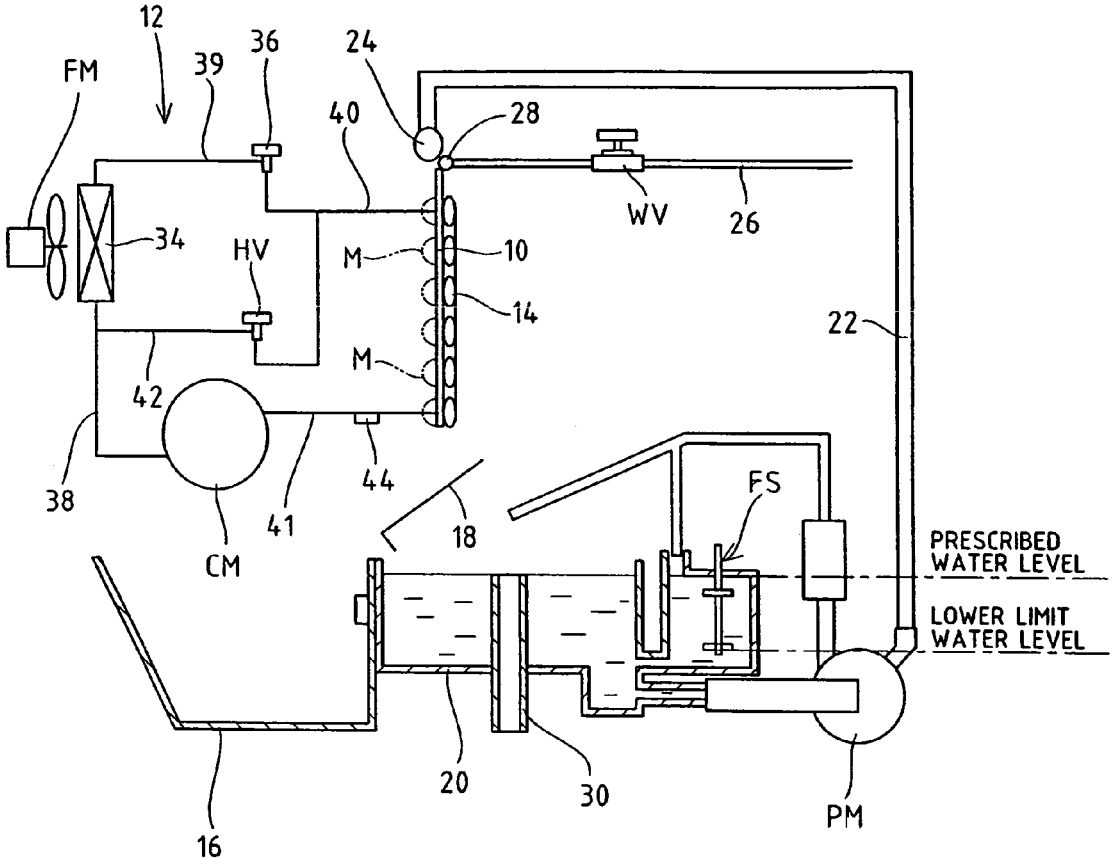
FIG. 1 is a schematic configurational diagram of a down flow type automatic ice making machine according to a first embodiment.

FIG. 1 shows the schematic configuration of a down flow type automatic ice making machine according to the first embodiment, and the automatic ice making machine is configured so that an evaporation tube (evaporator) 14 constituting a freezing apparatus 12 is closely fixed to the back surface of an ice making plate (ice making unit) 10 arranged vertically, and a refrigerant is circulatively supplied to the evaporation tube 14 to forcibly cool the ice making plate 10 at the time of an ice making cycle. A guide plate 18 which guides ice blocks M, separated from the ice making plate 10 in a deicing cycle, to a stocker 16 disposed obliquely below is disposed directly under the ice making plate 10 in an inclined state. The guide plate 18 has multiple through holes (not shown) bored therethrough, so that ice making water supplied to the top surface of the ice making plate 10 (hereinafter called "ice making surface") at the time of the ice making cycle and deicing water supplied to the back surface of the ice making plate 10 at the time of the deicing cycle are collected in an ice-making water tank 20 located below through the through holes of the guide plate 18.

An ice-making water supply tube 22 led out from the ice-making water tank 20 via a circulation pump PM is connected to an ice-making water sprayer 24 provided above the ice making plate 10. Multiple spray holes (not shown) are bored through the ice-making water sprayer 24, so that ice-making water pumped out from the ice-making water tank 20 is sprayed onto the ice making surface of the ice making plate 10 through the spray holes at the time of the ice making cycle. Then, as the ice-making water flowing down on the ice making surface is frozen, a plurality of ice blocks M of a predetermined shape are produced on the ice making surface.

The illustrated automatic ice making machine is provided with a deicing-water supply system for spraying water of normal temperature (hereinafter called "deicing water") on the back surface of the ice making plate 10 at the time of the deicing cycle to raise the temperature of the ice making plate 10, thereby promoting ice separation, in addition to an ice-making water supply system which comprises the circulation pump PM, the ice-making water supply tube 22, the ice-making water sprayer 24 and the ice-making water tank 20. That is, as shown in FIG. 1, the deicing-water supply system comprises a deicing water supply tube 26 connected to an external tap water system, a deicing water sprayer 28 provided at the upper portion of the back surface of the ice making plate 10 and connected with the deicing water supply tube 26, and a water feed valve (deicing water supplying means) WV, such as an electromagnetic valve, inserted in the deicing water feed tube 26. As the water feed valve WV is opened at the time of the deicing cycle, deicing water supplied from the external tap water system is sprayed on the back surface of the ice making plate 10 via multiple spray holes (not shown) formed in the deicing water sprayer 28 and flows down on the back surface to heat the ice making plate 10, thereby accelerating melting of the freezing surfaces of the ice blocks M with the ice making plate 10. The deicing water which has flowed down on the back surface of the ice making plate 10, like the ice making water, is collected in the ice-making water tank 20 through the through holes in the guide plate 18, and is used as ice making water in the next ice making cycle.

An overflow tube 30 is provided at the ice-making water tank 20 to prescribe the amount of ice making water stored therein. That is, when the deicing water collected in the ice-making water tank 20 at the time of the deicing cycle exceeds a prescribed water level prescribed by the overflow tube 30, the deicing water is discharged outside the machine through the overflow tube 30. The amount of deicing water to be stored to the position of the prescribed water level is set to a prescribed amount of ice making water which is needed at the time of the ice making cycle.

A float switch FS shown in FIG. 1 is disposed at the ice-making water tank 20. The float switch FS detects the water level in the ice-making water tank 20, and is set to become ON when the actual water level is higher than a preset lower water level limit, and become OFF when it drops down to the lower water level limit. In the first embodiment, the ice making cycle starts from an upper water level limit prescribed by the overflow tube 30, production of ice blocks M on the ice making plate 10 lowers the water level in the ice-making water tank 20, and the water level when complete ice blocks M are produced is set to the lower water level limit.

As shown in FIG. 1, the freezing apparatus 12 comprises a compressor CM, a condenser 34, an expansion valve 36 and the evaporation tube 14 connected together in the named order by refrigerant tubes 38, 39, 40, 41 in such a way that the refrigerant circulates. In the ice making cycle, a vapor refrigerant compressed by the compressor CM travels through the discharge tube (refrigerant tube) 38 to the condenser 34 to be condensed and liquefied, and a liquefied refrigerant depressurized by the expansion valve 36 through the first supply tube (refrigerant tube) 39 flows into the evaporation tube 14 through the second supply tube (refrigerant tube) 40 to be expanded and vaporized at once for heat exchange with the ice making plate 10 to cool down the ice making plate 10 below the freezing temperature. The vapor refrigerant vaporized in the evaporation tube 14 repeats a cycle of being fed back to the compressor CM through the suction tube (refrigerant tube) 41 and supplied to the condenser 34 again.

Figure 2:
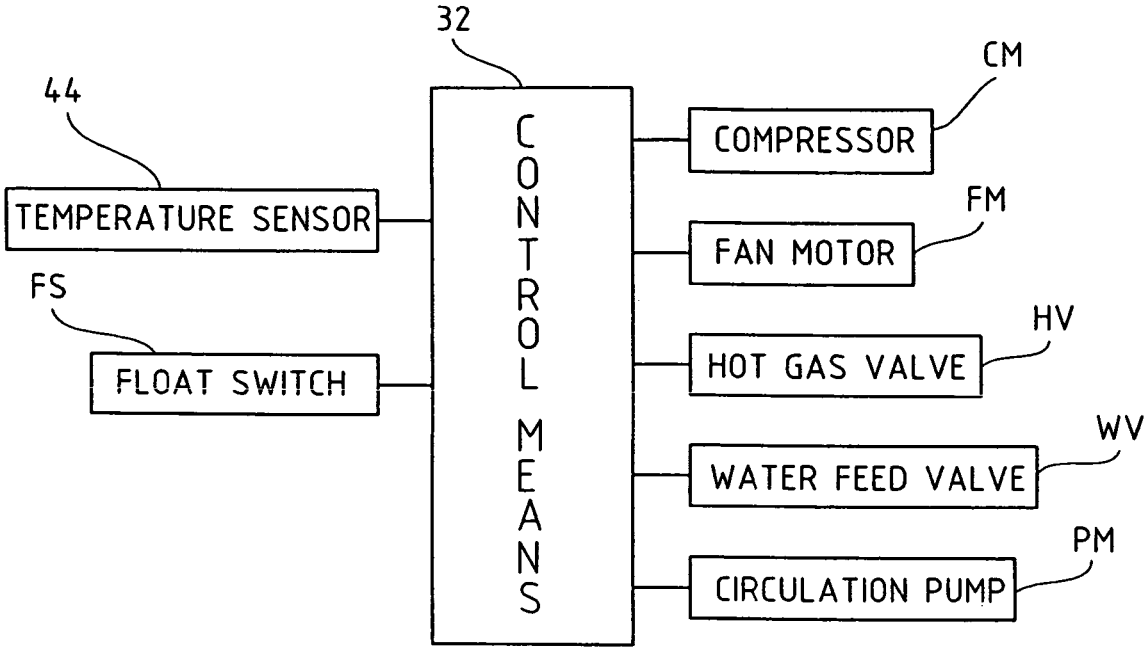
FIG. 2 is a control block diagram of the automatic ice making machine according to the first embodiment.

The freezing apparatus 12 has a hot gas tube 42, which is branched from the discharge tube 38 of the compressor CM and is communicated with the second supply tube 40 connected to the inlet side of the evaporation tube 14 via a hot gas valve HV. The hot gas valve HV is controlled by control means 32 shown in FIG. 2 in such a way that the hot gas valve HV is closed at the time of the ice making cycle and is opened at the time of the deicing cycle. That is, the hot gas valve HV is configured in such a way that in the deicing cycle, a hot and high-pressure hot gas (heating means) discharged from the compressor CM is bypassed to the evaporation tube 14 via the opened hot gas valve HV and the hot gas tube 42, so that the hot gas heats the ice making plate 10 to melt the ice forming surfaces of ice blocks M produced on the ice making surface, thereby causing the ice blocks M to drop by the dead weight. That is, with the compressor CM in operation, as the opening/closing of the hot gas valve HV is controlled, the ice making cycle and the deicing cycle are repeated alternately, making ice blocks M. Reference numeral FM in the diagram indicates a fan motor which is operated (ON) at the time of the ice making cycle to air-cool the condenser 34.

A temperature sensing section of a temperature sensor 44, such as a thermistor, as temperature detection means for detecting the outlet temperature of the refrigerant after heat exchange with the ice making plate 10 is disposed in close to the suction tube 41 connected to the refrigerant outlet side of the evaporation tube 14. The temperature detected by the temperature sensor 44 is input to the control means 32.

The automatic ice making machine has control means 32 comprising a microcomputer or the like which performs the general electric control of the automatic ice making machine. The control means 32 is connected with the compressor CM, the fan motor FM, the hot gas valve HV, the water feed valve WV, the circulation pump PM, the temperature sensor 44, and the float switch FS. The control means 32 performs control to stop the ice making cycle and change it over to the deicing cycle when the water level in the ice-making water tank 20 drops down to the lower water level limit after the initiation of the ice making cycle and the float switch FS is set OFF from ON (the lower water level limit is detected). The control means 32 is set to perform control to stop the deicing cycle and change it over to the ice making cycle when the temperature sensor 44 detects that the temperature of a hot gas which rapidly rises as a consequence of separation of ice blocks M from the ice making plate 10 heated by the hot gas supplied to the evaporation tube 14 after the initiation of the deicing cycle has reached a preset deicing completion temperature.

The control means 32 is set to control the opening/closing of the water feed valve WV at the time of the deicing cycle based on a water supply program stored in a built-in RAM (not shown). The control means 32 in the first embodiment opens the water feed valve WV when the float switch FS detects the lower water level limit (when the deicing cycle is initiated), and closes the water feed valve WV when a preset water feed time $T_0$ elapses since the initiation of the deicing cycle. After elapse of the water feed time $T_0$, the control means 32 controls the opening/closing of the water feed valve WV in such a way that a cycle of opening the water feed valve WV only for an intermittent water feed time $T_2$ every time a preset intermittence stop time $T_1$ elapses is repeated until the temperature sensor 44 detects the deicing completion temperature (until the deicing cycle is completed) (see FIG. 3). In the first embodiment, the start of measurement of the intermittence stop time $T_1$ in the first cycle is set to a point of time when the water feed time $T_0$ has elapsed. According to the first embodiment, the control means 32 also serves as detection means to detect that the deicing water supplied to the ice making plate 10 has reached a predetermined amount at the time of the deicing cycle.

The water feed time $T_0$ is set in such a way that the amount of deicing water to be supplied to the ice making plate 10 from the external tap water system becomes greater than the prescribed amount in the ice-making water tank 20 which is prescribed by the overflow tube 30, so that the next ice making water does not become insufficient. The intermittence stop time $T_1$ and the intermittent water feed time $T_2$ are set to adequate values according to the relationship between the degree of a hot-gas oriented rise in the temperature of the ice making plate 10 at the time of deicing and the amount of consumed deicing water during intermittent water supply; for example, when the water feed time $T_0$ is 150 seconds, the intermittence stop time $T_1$ is set to 20 seconds and the intermittent water feed time $T_2$ is set to 10 seconds. That is, the intermittent water feed time $T_2$ is set to ½ of the intermittence stop time $T_1$, and stopping of water supply, and water supply are repeated alternately.

Operation of First Embodiment

Next, the operation of the automatic ice making machine according to the first embodiment will be described in conjunction with the operation method referring to a timing chart shown in FIG. 3. At the time of the ice making cycle, a refrigerant is circulatively supplied to the evaporation tube 14 disposed at the back surface of the ice making plate 10 to cool down the ice making plate 10. Further, the operation of the circulation pump PM causes the ice making water from the ice-making water tank 20 to be pumped out to the ice-making water sprayer 24 to be sprayed onto the ice making surface of the ice making plate 10 through the individual spray holes of the ice-making water sprayer 24. At the time the ice making cycle starts, the ice making water is stored in the ice-making water tank 20 to the prescribed water level prescribed by the overflow tube 30, and the float switch FS is in the ON state.

The ice making plate 10 exchanges heat with the refrigerant circulated in the evaporation tube 14 to be forcibly cooled, so that the ice making water supplied to the ice making surface of the ice making plate 10 from the ice-making water tank 20 via the circulation pump PM gradually starts being frozen. The ice making water which has flowed down on the ice making surface without being frozen is collected in the ice-making water tank 20 through the through holes of the guide plate 18, and is supplied to the ice making plate 10 again as the circulation pump PM is operated. The gradual freezing of the ice making water on the ice making plate 10 reduces the ice making water to be collected in the ice-making water tank 20, thus gradually lowering the water level of the ice making water in the tank 20.

When the float switch FS becomes OFF as ice blocks M of a predetermined size are produced on the ice making plate 10 and the water level of the ice making water in the ice-making water tank 20 drops to the lower water level limit, the control means 32 controls the individual units to change over the ice making cycle to the deicing cycle. That is, the control means 32 stops the fan motor FM and the circulation pump PM (OFF), and opens the hot gas valve HV (ON) while keeping the compressor CM in operation. Accordingly, with the circulative supply of ice making water being stopped, the hot gas is supplied to the evaporation tube 14 through the hot gas tube 42 to heat the ice making plate 10, causing the freezing surfaces of the ice blocks M with the ice making plate 10 to start melting. Further, the control means 32 opens the water feed valve WV to start supplying the deicing water (tap water of normal temperature) to the deicing water sprayer 28. The deicing water supplied to the deicing water sprayer 28 is sprayed onto the back surface of the ice making plate 10 through the spray holes, raising the temperature of the ice making plate 10 to accelerate melting of the freezing surfaces of the ice blocks M with the ice making plate 10.

Figure 3:
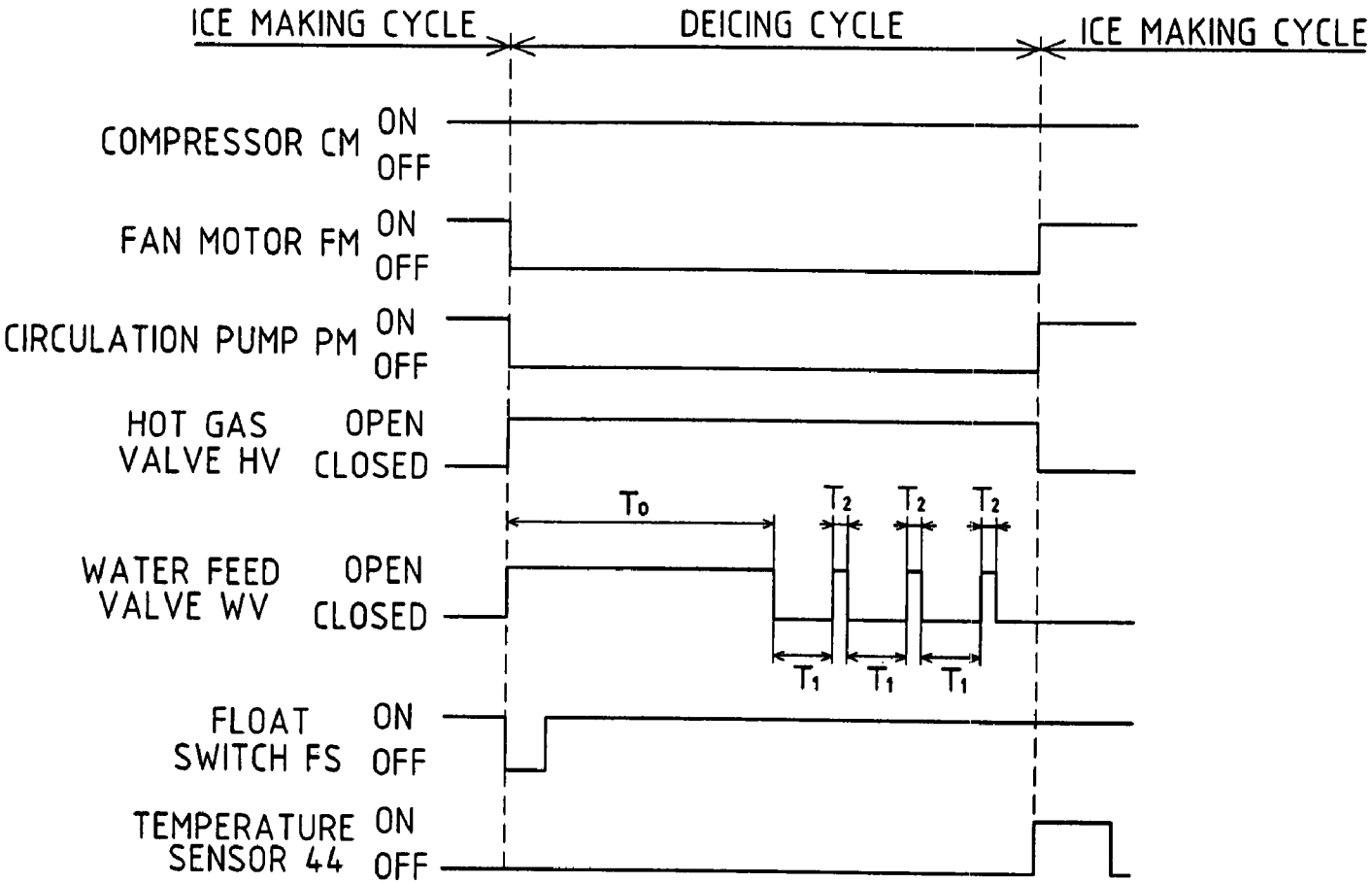
FIG. 3 is a timing chart diagram when the automatic ice making machine according to the first embodiment is in operation.

As shown in FIG. 3, when the water feed time $T_0$ elapses after the initiation of the deicing cycle, the control means 32 temporarily stops supplying the deicing water which has been supplied continuously by closing the water feed valve WV. At this time, the deicing water (ice making water) is stored in the ice-making water tank 20 to the prescribed water level prescribed by the overflow tube 30, and the float switch FS is in the ON state. Upon elapse of the intermittence stop time $T_1$ whose measurement has started since the point of time of closing the water feed valve WV or the point of elapse of the water feed time $T_0$, the control means 32 opens the water feed valve WV again to supply the deicing water to the back surface of the ice making plate 10. Then, the control means 32 performs control in such a way that upon elapse of the intermittent water feed time $T_2$ whose measurement has started since the point of elapse of the intermittence stop time $T_1$ (the point of time of opening the water feed valve WV), the control means 32 closes the water feed valve WV to stop supplying the deicing water, and when the intermittence stop time $T_1$ whose measurement has started since the point of elapse of the intermittent water feed time $T_2$ elapses again, the control means 32 opens the water feed valve WV. That is, after the water feed time $T_0$ elapses, the cycle of intermittently supplying the deicing water to the ice making plate 10 only for the intermittent water feed time $T_2$ every time the intermittence stop time $T_1$ elapses is repeated.

When all the ice blocks M are separated from the ice making plate 10 and the temperature sensor 44 detects the deicing completion temperature as a consequence of the temperature rise of the hot gas, the control means 32 completes the deicing cycle and starts the ice making cycle.

As the automatic ice making machine according to the first embodiment intermittently supplies deicing water to the ice making plate 10 after a prescribed amount of deicing water is collected in the ice-making water tank 20, it is possible to prevent the ice making surface of the ice making plate 10 heated by the hot gas from being dried. That is, the supply of the deicing water to the ice making plate 10 can suppress a rise in the temperature of the ice making plate 10 and prevent the ice making plate 10 from being dried, so that stains are not adhered to the icemaking plate 10. In addition, elongation of the deicing time due to adhesion of stains can be prevented, thus suppressing deterioration of the ice making performance. Further, due to the suppression of overheating of the ice making plate 10 by the intermittent supply of the deicing water, it is possible to prevent resin components or the like disposed around the ice making plate 10 from being damaged. The amount of deicing water supplied during intermittent supply of the deicing water is small, and the amount of deicing water wastefully discharged can be suppressed to the minimum level. Because the first embodiment uses a hot gas as the heating means, it is unnecessary to use another heating means like a heater, which can simplify the configuration of the automatic ice making machine.

Second Embodiment

The cause of making the deicing cycle longer is the progress of adhesion of stains to the ice making surface of the ice making plate 10 with time as mentioned above, and the new automatic ice making machine completes the deicing cycle within an allowable time which does not bring about the problem originated from drying/overheating of the ice making plate 10. When the deicing cycle becomes long due to adhesion of stains to the ice making plate 10 with time or time-dependent degradation or the like, executing the intermittent supply of deicing water which has been explained in the foregoing description of the first embodiment can prevent the deicing cycle from becoming longer. In this case, when the time needed to complete the deicing cycle after elapse of the water feed time $T_0$ of the deicing water falls within a predetermined time, the elongation of the deicing time or overheating of the ice making plate 10 due to adhesion of stains does not become problematic without intermittent supply of deicing water.

Accordingly, the automatic ice making machine according to the second embodiment is configured to estimate the time needed until completion of the deicing cycle since the point of elapse of the water feed time $T_0$ in which the deicing water is continuously supplied to the ice making plate 10, and postpone the completion of the deicing cycle without performing the intermittent supply of the deicing water when the estimated time $T_3$ is shorter than a preset cancel time $T_4$. Because the fundamental configuration of the automatic ice making machine according to the second embodiment is the same as that of the first embodiment, only different portions will be described, and same reference numerals are given to same members.

Figure 4:
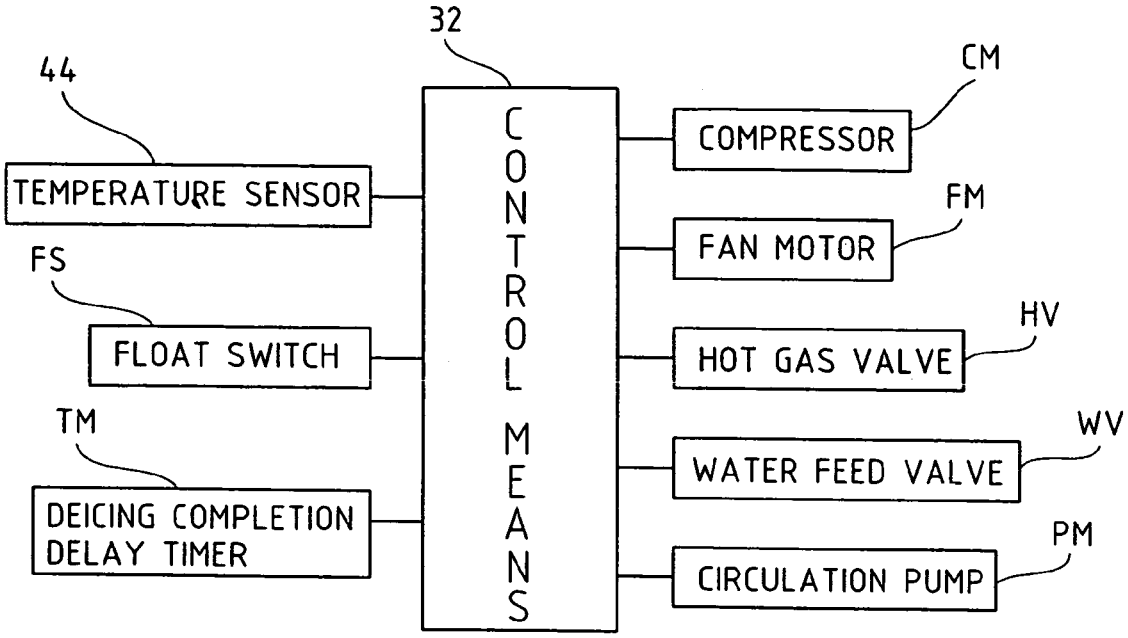
FIG. 4 is a control block diagram of an automatic ice making machine according to a second embodiment.

That is, the control means 32 as shown in FIG. 4 is configured to estimate the time needed until the temperature of the hot gas detected by the temperature sensor 44 at the time of elapse of the water feed time $T_0$ becomes the deicing completion temperature and a delay time $T_5$ of a deicing completion delay timer TM to be described later elapses, and compare the estimated time $T_3$ with the cancel time $T_4$. The control means 32 is set to control the operation of the water feed valve WV in such a way as not to perform the intermittent supply of the deicing water, and postpone the completion of the deicing cycle (completion of time measurement by the deicing completion delay timer TM) when the control means 32 determines that the estimated time $T_3$ is shorter than the cancel time $T_4$ (see FIG. 5(*a*)). In the second embodiment, it is assumed that the temperature sensor 44 may detect the deicing completion temperature before the water feed time $T_0$ elapses, in which case the control means 32 is set to compare the remaining time from the point of elapse of the water feed time $T_0$ to the completion of measurement of the delay time $T_5$ by the deicing completion delay timer TM, as the estimated time $T_3$, with the cancel time $T_4$.

Figure 5:
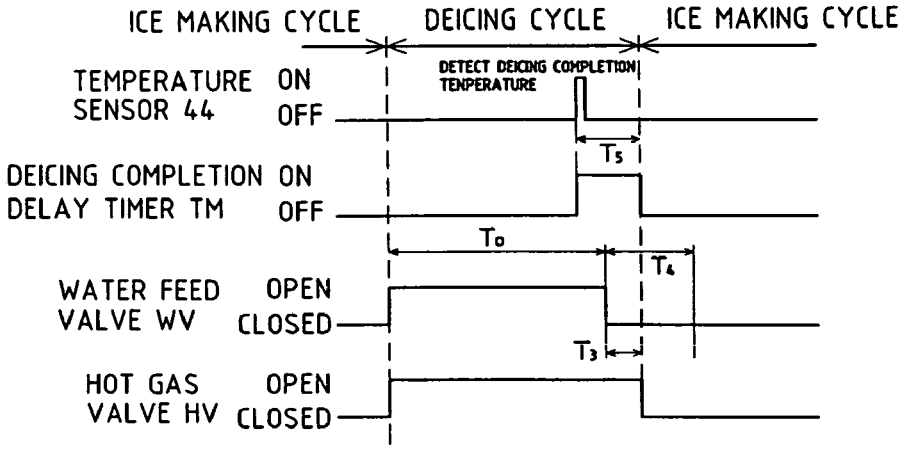
FIG. 5 is a timing chart diagram when the automatic ice making machine according to the second embodiment is in operation.
Figure 5:
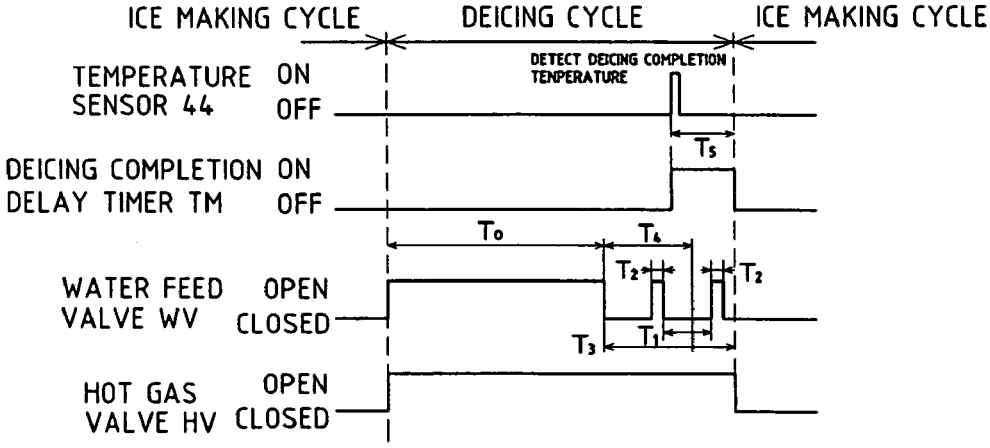
Figure 5:
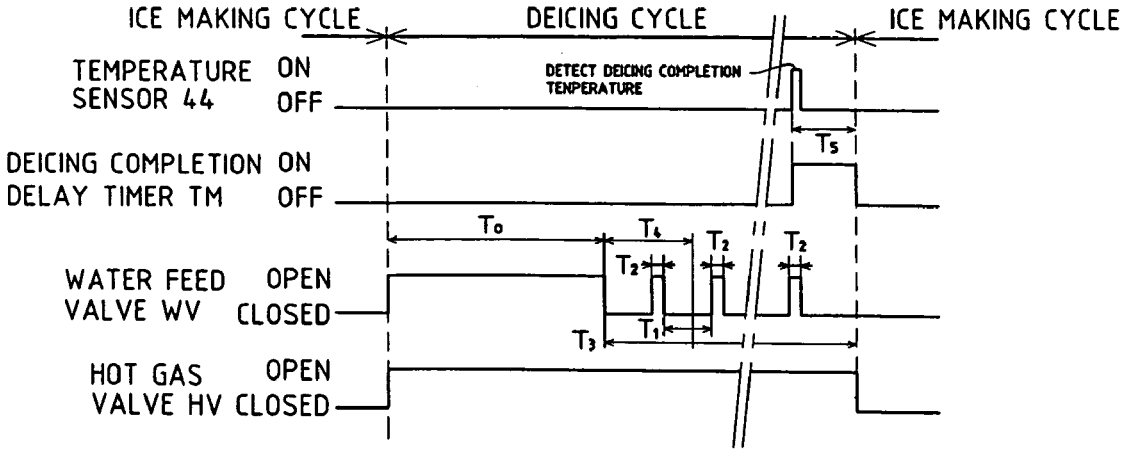

When it is determined that the estimated time $T_3$ is longer than the cancel time $T_4$ (see FIGS. 5(*b*) and 5(*c*)), on the other hand, the control means 32 is set to control the operation of the water feed valve WV in such a way as to perform the intermittent supply of the deicing water in which the intermittence stop time $T_1$ and the intermittent water feed time $T_2$ in the first embodiment are repeated. When the temperature sensor 44 detects the deicing completion temperature, the control means 32 controls to terminate the deicing cycle after time measurement by the deicing completion delay timer TM is completed, and start the ice making cycle. The control means 32 is set to control the operation of the water feed valve WV in such a way as not to perform the intermittent supply of the deicing water after the temperature sensor 44 detects the deicing completion temperature. While the cancel time $T_4$ is set to an adequate value in consideration of the conjunction with the degree of a rise in the temperature of the ice making plate 10 at the time of deicing with the hot gas alone, it is set to, for example, 60 seconds.

The temperature of the hot gas at the time of separation of all the ice blocks M from the ice making plate 10 changes according to a change in the ambient temperature of the site of the automatic ice making machine, so that if the deicing cycle is completed at the preset deicing completion temperature, there is a possibility that the cycle is shifted to the ice making cycle with the ice blocks M unseparated. Therefore, the second embodiment is configured in such a way that the deicing completion delay timer TM which starts measuring the time after the detection of the deicing completion temperature by the temperature sensor 44 is provided (see FIG. 4), and the control means 32 performs control to complete the deicing cycle and shift it to the ice making cycle when the delay time $T_5$ set in the deicing completion delay timer TM elapses. This can make it possible to prevent shifting to the ice making cycle without separation of ice blocks M depending on a change in ambient temperature. While the delay time $T_5$ is set to an adequate value according to the site or the like of the automatic ice making machine, it is set to, for example, 30 seconds.

Operation of Second Embodiment

Next, the operation of the automatic ice making machine according to the second embodiment will be described in conjunction with the operation method referring to a timing chart shown in FIG. 5. A description on the same operation as that of the first embodiment will be omitted.

(When the automatic ice making machine is new and the deicing cycle is completed in an allowable time)

When the deicing cycle progresses to separate ice blocks M from the ice making plate 10, and the temperature of the hot gas rises so that the temperature sensor 44 detects the deicing completion temperature, the deicing completion delay timer TM starts measuring the time. When the outside temperature is high or when the ice making surface of the ice making plate 10 does not have upheavals originated from time-dependent degradation so that separation of ice blocks M is carried out smoothly, the temperature sensor 44 detects the deicing completion temperature before the water feed time $T_0$ elapses as shown in FIG. 5(*a*), but the prescribed amount of ice making water needed in the next ice making cycle is secured for the completion of the deicing cycle is delayed by the deicing completion delay timer TM. Further, delaying the completion of the deicing cycle by the delay time $T_5$ after detection of the deicing completion temperature by the temperature sensor 44 can ensure shifting to the ice making cycle after all the ice blocks M are surely separated. Thus, it is possible to prevent occurrence of so-called double ice making in which the ice making cycle is carried out with ice blocks M remaining on the ice making plate 10.

As shown in FIG. 5(*a*), when the water feed time $T_0$ elapses after the initiation of the deicing cycle, the control means 32 temporarily stops supplying the deicing water which has been supplied continuously by closing the water feed valve WV. At this time, the temperature sensor 44 has already detected the deicing completion temperature and the deicing completion delay timer TM has already started measuring the time, in which case the control means 32 compares the remaining time from the point of elapse of the water feed time $T_0$ to the completion of measurement of the delay time $T_5$ by the deicing completion delay timer TM, as the estimated time $T_3$, with the preset cancel time $T_4$.

When the automatic ice making machine is new so that the ice making surface of the ice making plate 10 is not stained or does not have upheavals formed by time-dependent degradation or the like, the time needed for the deicing cycle is short, so that the estimated time $T_3$ is shorter than the cancel time $T_4$. Therefore, the control means 32 controls the operation of the water feed valve WV in such a way as not to perform the intermittent supply of the deicing water and postpones the completion of the deicing cycle. That is, even when the intermittence stop time $T_1$ whose measurement has started from the point of elapse of the water feed time $T_0$ elapses before the elapse of the delay time $T_5$ of the deicing completion delay timer TM, the intermittent supply of the deicing water is not performed. This can suppress the amount of consumed deicing water.

Then, after time measurement by the deicing completion delay timer TM is completed, the control means 32 completes the deicing cycle and starts the ice making cycle.

(When completion of the deicing cycle becomes longer than the allowable time due to time-dependent degradation or the like of the automatic ice making machine)

When the ice making surface of the ice making plate 10 is stained or has upheavals formed by time-dependent degradation or the like, ice blocks M are not smoothly separated, so that as shown in FIGS. 5(*b*) and 5(*c*), the water feed time $T_0$ elapses before the temperature sensor 44 detects the deicing completion temperature. The control means 32 estimates the time needed until the temperature of the hot gas detected by the temperature sensor 44 at the time of elapse of the water feed time $T_0$ becomes the deicing completion temperature and the delay time $T_5$ of the deicing completion delay timer TM elapses, and compares the estimated time $T_3$ with the cancel time $T_4$When the control means 32 determines that the estimated time $T_3$ is longer than the cancel time $T_4$, the control means 32 controls the operation of the water feed valve WV in such a way as to perform the intermittent supply of the deicing water. That is, upon elapse of the intermittence stop time $T_1$ whose measurement has started since the point of elapse of the water feed time $T_0$, the control means 32 opens the water feed valve WV again to supply the deicing water to the back surface of the ice making plate 10. Then, the control means 32 performs control in such a way that upon elapse of the intermittent water feed time $T_2$ whose measurement has started since the point of elapse of the intermittence stop time $T_1$ (the point of time of opening the water feed valve WV), the control means 32 closes the water feed valve WV to stop supplying the deicing water, and when the intermittence stop time $T_1$ whose measurement has started since the point of elapse of the intermittent water feed time $T_2$ elapses again, the control means 32 opens the water feed valve WV, thereby repeating the cycle of intermittently supplying the deicing water to the ice making plate 10.

When the temperature sensor 44 detects the deicing completion temperature, the deicing completion delay timer TM starts measuring the time, and the control means 32 completes the deicing cycle and starts the ice making cycle upon elapse of the delay time $T_5$When the temperature sensor 44 detects the deicing completion temperature during the intermittent water feed time $T_2$, the supply of the deicing water is kept without interrupting the supply of the deicing water in the intermittent water feed time $T_2$, and intermittent supply of the deicing water thereafter is not carried out.

Modifications

The present application is not limited to the structures of the individual embodiments, and other structures can be adopted as needed.

1Although the foregoing descriptions of the embodiments have been given of the case of controlling the water feed valve based on the water supply program set in the control means, the opening/closing of the water feed valve may be controlled by the control means using timers which respectively measure the water feed time, the intermittence stop time and the intermittent water feed time. That is, when the timer for the water feed time, which is activated at the same time as the initiation of the deicing cycle, measures the water feed time, the water feed valve is controlled to be closed. After the water feed time timer has measured the water feed time, control of opening the water feed valve when the timer for the intermittence stop time, which is activated at the time the timer for the water feed time has measured the water feed time, measures the intermittence stop time, closing the water feed valve when the timer for the intermittent water feed time, which is activated at the time the timer for the intermittence stop time has measured the intermittent water feed time, and opening the water feed valve when the timer for the intermittence stop time, which is activated at the time the timer for the intermittent water feed time has measured the intermittent water feed time, measures the intermittence stop time, is repeated until the deicing cycle is completed. In the modification, the timer for the water feed time serves as detection means which detects that a predetermined amount of deicing water is supplied at the time of the deicing cycle. The configuration is not limited to the one which uses three timers to measure the water feed time, the intermittence stop time and the intermittent water feed time, and they may be measured by a single timer.

The control means may be allowed to perform the function of the deicing completion delay timer in the second embodiment. That is, a water supply program which does not perform intermittent supply of deicing water when the estimated time is shorter than the cancel time may be set in the control means.

2Although the second embodiment is configured so that the deicing cycle is completed when the delay time of the deicing completion delay timer elapses after detection of the deicing completion temperature by the temperature sensor (temperature detection means), the deicing cycle may be completed when the temperature sensor detects the deicing completion temperature without providing the deicing completion delay timer. In this case, the control means is configured to estimate the time needed for the hot gas to become the deicing completion temperature from the temperature detected by the temperature sensor upon elapse of the water feed time since the elapse of the water feed time, and compare the estimated time with the cancel time.

3Although the supply of deicing water is temporarily stopped when the water feed time elapses at the time of the deicing cycle in the embodiments, the supply of a predetermined amount of deicing water may be stopped when detection means, such as the float switch, for detecting the water level of the deicing water stored in the ice-making water tank detects the prescribed water level.

4Although a float switch has been explained as ice-making completion detecting means which detects completion of the ice making cycle in the foregoing descriptions of the embodiments, the temperature sensor which detects the deicing completion temperature may be used as the ice-making completion detecting means, so that when the temperature sensor detects an ice-making completion temperature, the ice making cycle is stopped and is shifted to the deicing cycle. Alternatively, a timer may be used as the ice-making completion detecting means, so that when an ice making time preset in the timer elapses, the ice making cycle is shifted to the deicing cycle.

5 Although the foregoing descriptions of the embodiments have been given of the case where the ice making unit comprises a single ice making plate, the ice making unit may comprise two ice making plates arranged to face each other with the evaporation tube in between.

6 Although the embodiments are configured to heat the ice making plate by supplying a hot gas to the evaporation tube at the time of the deicing cycle, it is possible to take a configuration where a heater as heating means is provided at the ice making plate so that the ice making plate is heated by the heater.

7 Although the foregoing descriptions of the embodiments have been given of the case where control of supplying deicing water supplied from an external tap water system to the ice making unit is executed by opening/closing the water feed valve as deicing water supply means, the configuration is not restrictive. For example, it is possible to take a configuration where control of supplying deicing water to the ice making unit is executed by setting a pump connected to a deicing water tank where a predetermined amount of deicing water is stored ON or OFF, in which case the pump serves as the deicing water supply means.

8 Although the embodiments have been described by way of example where a down flow type ice making machine is used as an automatic ice making machine, an ejection type, such as an open cell type or a close cell type, or other various types may be used as long as deicing water is used at the time of the deicing cycle.

The invention claimed is:

1. An operation method for an automatic ice making machine which supplies ice making water to an ice making unit (10) cooled by a refrigerant supplied to an evaporator (14) to produce ice blocks (M) at a time of an ice making cycle, and heats the ice making unit (10) with heating means to separate the ice blocks (M) from the ice making unit (10) at a time of a deicing cycle, characterized in that at the time of the deicing cycle, a predetermined amount of deicing water is continuously supplied to the ice making unit (10) from deicing water supplying means (WV) after which the deicing water is intermittently supplied to the ice making unit (10) from the deicing water supplying means (WV).

2. The operation method according to claim 1, wherein a time needed from stopping of continuous supply of the deicing water to the ice making unit (10) to completion of the deicing cycle is estimated, and when the estimated time ($T_3$) is shorter than a preset cancel time ($T_4$), intermittent supply of the deicing water to the ice making unit (10) is not performed.

3. An automatic ice making machine configured to supply ice making water to an ice making unit (10) cooled by a refrigerant supplied to an evaporator (14) to produce ice blocks (M) at a time of an ice making cycle, and heat the ice making unit (10) with heating means to separate the ice blocks (M) from the ice making unit (10) at a time of a deicing cycle, characterized by comprising:

detection means for detecting that a predetermined amount of deicing water is continuously supplied to the ice making unit (10) from deicing water supplying means (WV) at the time of the deicing cycle; and control means (32) for controlling an operation of the deicing water supplying means (WV) in such a way as to intermittently supply the deicing water to the ice making unit (10) from the deicing water supplying means (WV) until the deicing cycle is completed after detection of the supply of the predetermined amount of deicing water by the detection means.

4. The automatic ice making machine according to claim 3, wherein the control means (32) estimates a time needed from stopping of continuous supply of the deicing water to the ice making unit (10) to completion of the deicing cycle, and controls the operation of the deicing water supplying means (WV) in such a way as not to intermittently supply the deicing water to the ice making unit (10) when the estimated time ($T_3$) is shorter than a preset cancel time ($T_4$).

5. The automatic ice making machine according to claim 3, configured to collect the deicing water supplied to the ice making unit (10) in an ice-making water tank (20) at the time of the deicing cycle, discharge that amount of deicing water collected in the ice-making water tank (20) which is more than a prescribed amount of deicing water outside, and use the prescribed amount of deicing water as ice making water in a next ice making cycle.

6. The automatic ice making machine according to claim 4, configured to collect the deicing water supplied to the ice making unit (10) in an ice-making water tank (20) at the time of the deicing cycle, discharge that amount of deicing water collected in the ice-making water tank (20), the water is more than a prescribed amount of deicing water outside, and use the prescribed amount of deicing water as ice making water in a next ice making cycle.

* * * * *